US008765342B2

(12) United States Patent
Wu

(10) Patent No.: US 8,765,342 B2
(45) Date of Patent: Jul. 1, 2014

(54) PHOTOCONDUCTORS

(71) Applicant: Xerox Corporation, Norwalk, CT (US)

(72) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 26 days.

(21) Appl. No.: 13/668,244

(22) Filed: Nov. 3, 2012

(65) Prior Publication Data

US 2014/0127616 A1 May 8, 2014

(51) Int. Cl.
*G03G 5/147* (2006.01)

(52) U.S. Cl.
USPC ..... 430/66

(58) Field of Classification Search
USPC ..... 430/66
See application file for complete search history.

(56) References Cited

U.S. PATENT DOCUMENTS

| | | | | |
|---|---|---|---|---|
| 5,215,843 | A | 6/1993 | Aizawa | |
| 7,498,108 | B2 | 3/2009 | Wu et al. | |
| 7,799,494 | B2 | 9/2010 | Wu et al. | |
| 7,811,732 | B2 | 10/2010 | Wu | |
| 7,897,311 | B2 | 3/2011 | Wu | |
| 2008/0003513 | A1* | 1/2008 | Yanus et al. | 430/58.05 |
| 2008/0199795 | A1* | 8/2008 | Ogaki et al. | 430/66 |
| 2009/0208857 | A1* | 8/2009 | Wu et al. | 430/58.8 |
| 2013/0260295 | A1* | 10/2013 | Iwadate et al. | 430/56 |

* cited by examiner

*Primary Examiner* — Hoa V Le
(74) *Attorney, Agent, or Firm* — Eugene O. Palazzo

(57) ABSTRACT

A photoconductor containing an optional anticurl layer, a supporting substrate, an optional ground plane layer, an optional hole blocking layer, an optional adhesive layer, a photogenerating layer, a charge transport layer, and an overcoat layer mixture of a charge transport compound, a melamine resin, an optional acid catalyst, and a fluoro component.

20 Claims, 1 Drawing Sheet

PHOTOCONDUCTORS

There is disclosed a photoconductor comprising an optional anti-curl layer, an optional supporting substrate, an optional ground plane layer, an optional hole blocking layer, an optional adhesive layer, a photogenerating layer, a charge transport layer that includes a charge transporting compound, and an overcoat layer comprising a charge transport compound, a fluoro containing component, an optional catalyst, and a melamine resin.

BACKGROUND

Various photoconductors that are selected for imaging systems, such as xerographic imaging processes, are known. These photoconductors usually contain certain photogenerating layer pigments and charge transport layer components. A problem associated with a number of the known photoconductors is that they have a minimum, or lack resistance of, to abrasion from dust, charging rolls, toner, and carrier. Further, the surface layers of photoconductors are subject to scratches, which decrease their lifetime, and in xerographic imaging systems adversely affect the quality of the developed images.

While used photoconductor components can be partially recycled, there continues to be added costs and potential environmental hazards when recycling.

In xerographic systems, extending photoreceptor life using robust layers, such as overcoats, can in some instances cause undesirable increased lateral charge migration (LCM) due to lowered wear rates and accumulation of polar and conductive chemical species on the photoconductor and friction between the cleaning blade and the photoconductor surface. Increased friction is particularly pronounced in BCR (biased charging roll) charging systems where friction forces become excessive that the torque provided by the photoconductor motor is insufficient to even turn the photoconductor drum resulting in a torque failure, thereby rendering the xerographic system and machine inoperable. Under these circumstances, the cleaning blade chips and deforms to an extent where it is non-functional and causes cleaning streaks in the xerographic developed electrostatic images.

In addition, imaging members, such as photoconductors, are generally exposed to repetitive electrophotographic cycling, which subjects the exposed charged transport layer or alternative top overcoat layer thereof to mechanical abrasion, chemical attack, and heat. This repetitive cycling causes gradual deterioration in the mechanical and electrical characteristics of the exposed photoconductor surface layer. Physical and mechanical damage during prolonged use, including the formation of surface scratch defects, are examples of reasons for the failure of belt photoconductors.

Thus, there is a need for photoconductors that substantially avoid or minimize the disadvantages of a number of known photoconductors.

Also, there is a need for wear resistant photoconductors with excellent or acceptable mechanical characteristics, especially in xerographic systems where biased charging rolls (BCR) are used.

There is also a need to improve the mechanical robustness of photoconductors or photoreceptors, and to increase their scratch resistance, thereby prolonging their service life.

Additionally, there is a need for photoconductors that possess resistance to light shock to minimize image ghosting, and minimal background shading in xerographic developed images.

There also remains a need for improved imaging members that are wear resistant, and that provide in combination excellent imaging performance and extended lifetimes, and that possess reduced human and environmental health risks.

Further, there is a need for photoconductors that abate torque failures.

Wear resistant photoconductors with excellent cyclic characteristics and stable electrical properties, stable long term cycling, minimal charge deficient spots (CDS), and acceptable lateral charge migration (LCM) characteristics, such as excellent LCM resistance, are also desirable needs.

Yet another need resides in providing environmentally acceptable photoconductor overcoat layers that contain fluoro compounds that are soluble in a number of substantially toxic free solvents thereby avoiding the uneconomical preparation and use of dispersions with compounds that have insolubility or minimum solubility in common toxic fluorinated solvents.

These and other needs are believed to be achievable with the photoconductors disclosed herein.

SUMMARY

There is disclosed a photoconductor comprising an optional anticurl layer, an optional supporting substrate, an optional ground plane layer, an optional hole blocking layer, an optional adhesive layer, a photogenerating layer, a charge transport layer comprising a charge transport compound, and an overcoat layer in contact with the charge transport layer, the overcoat layer comprising a mixture of a charge transport compound, a melamine resin and a fluoro component as represented by at least one of the following formulas/structures

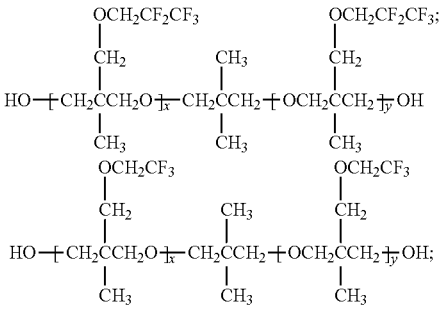

and

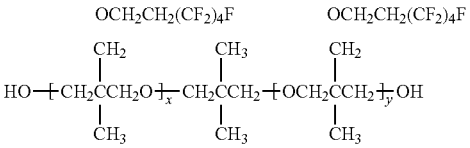

wherein x and y represent the number of repeating segments; a photoconductor comprising a supporting substrate, a photogenerating layer, a charge transport layer comprising a charge transport compound and an oleophobic overcoat layer in contact with the charge transport layer, the overcoat layer comprising a mixture of a charge transport compound, a melamine resin, and fluorinated compound as represented by the following formulas/structures

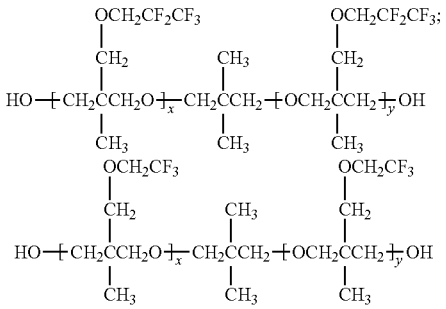

or

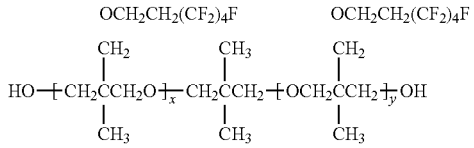

wherein x and y represent the number of repeating segments, with the x repeating segment being a number of from about 1 to about 40, the y repeating segment being a number of from about 1 to about 40, and the sum of x and y is from about 2 to about 60, and wherein the fluoride content is from about 10 to about 70 weight percent; and a photoconductor comprising an anticurl layer, a supporting substrate, a hole blocking layer, an adhesive layer, a photogenerating layer, at least one charge transport layer comprising a charge transport compound, and an overcoat layer in contact with the at least one charge transport layer, the overcoat layer comprising a crosslinked mixture of a charge transport compound, a melamine resin, an acid catalyst, and a fluoro compound as represented by the following formula/structures

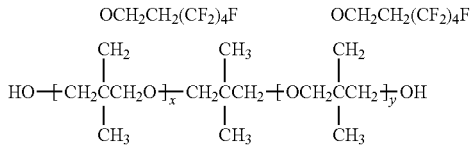

wherein x and y represent the number of repeating segments, and which photoconductor possesses a wear rate of from about 5 to about 20 nanometers/kilocycle, and wherein the mixture is from about 55 to about 99 percent crosslinked as determined by Fourier Transform Infrared Spectroscopy.

FIGURES

There are provided the following Figures to further illustrate the photoconductors disclosed herein.

EMBODIMENTS

In the specification and the claims that follow, singular forms such as "a," "an," and "the" include plural forms unless the content clearly dictates otherwise.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range from about 1 to about 99 also discloses the range from 1 to 99.

In embodiments of the present disclosure, there is illustrated a photoconductor comprising, in sequence, an optional anti-curl layer, an optional supporting substrate, an optional ground plane layer, an optional hole blocking layer, an optional adhesive layer, a photogenerating layer, at least one charge transport layer comprising a charge transport component, and a protective overcoat layer. More specifically, there is disclosed a photoconductor overcoat prepared with substantially non-toxic solvents, such as a solvent, like ketone, esters, and alcohols of, for example, isopropanol, and where the overcoat is comprised of an environmentally acceptable fluoro compound, such as a fluorinated polyether, a hydroxyl, or an alkoxy modified charge transport molecule, a melamine resin, and an optional acid catalyst like a blocked p-toluenesulfonic acid.

Figure 1:
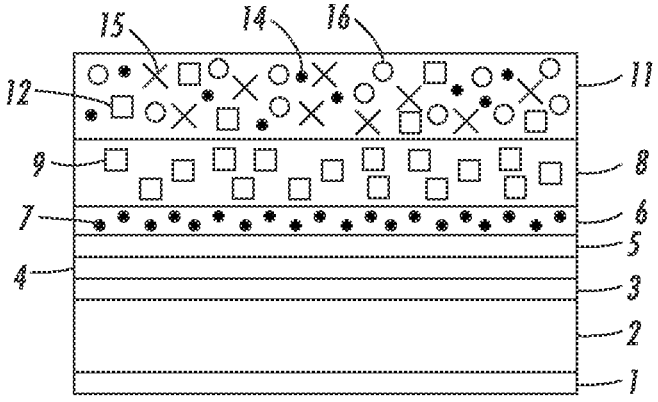
FIG. 1 illustrates an exemplary embodiment of an overcoated layered photoconductor of the present disclosure.
Figure 2:
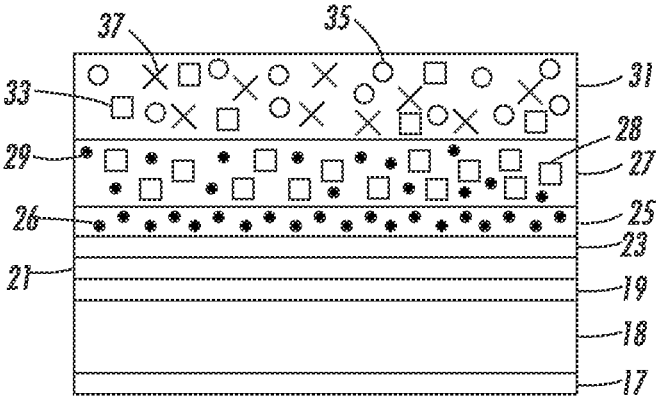
FIG. 2 illustrates an exemplary embodiment of a second overcoated layered photoconductor of the present disclosure

Exemplary and non-limiting examples of the photoconductors of the present disclosure are depicted in FIGS. 1 and 2.

In FIG. 1, there is illustrated an overcoated photoconductor comprising an optional anti-curl layer 1, an optional supporting substrate layer 2, an optional electrically conductive ground plane layer 3, an optional hole blocking layer 4, an optional adhesive layer 5, a photogenerating layer 6 containing photogenerating pigments 7, a charge transport layer 8 containing charge transport compounds 9, and an overcoat layer 11 comprising charge transport compounds 12, fluoro compounds 14, optional catalyst 15, and melamine resins 16.

In FIG. 2, there is illustrated an overcoated photoconductor comprising an optional anti-curl layer 17, an optional supporting substrate layer 18, an optional ground plane layer 19, an optional hole blocking layer 21, an optional adhesive layer 23, a photogenerating layer 25 containing photogenerating pigments 26, a charge transport layer 27 containing charge transport compounds 28 and a resin binder 29, and an overcoat layer 31, comprising charge transport compounds 33, environmentally friendly fluoro compounds 35, and melamine resin 37.

Fluoro Components or Fluoride Containing Components

The disclosed environmentally acceptable fluoro compounds or fluoride containing compounds include, for example, a fluorinated polyether, such as a hydroxyl terminated fluorinated polyether, that is based on poly(oxetane) polymers available from OMNOVA Solutions Inc. Compared to certain telomer-based and other conventional fluorochemicals, such as perfluoropolyethers (FLUOROLINK®), PFA, and PTFE, the disclosed poly(oxetane) based fluorinated polyethers, have been found to not bioaccumulate resulting in low environmental impacts. In addition, the disclosed environmentally acceptable fluorinated polyethers are soluble or dispersible in a variety of common organic solvents including ketones, alcohols and esters.

Examples of the fluoro or fluoride containing components or compounds included in the overcoat layer mixture of the disclosed photoconductors are represented by at least one of the following formulas/structures

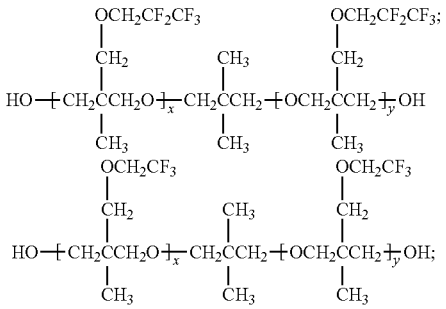

and

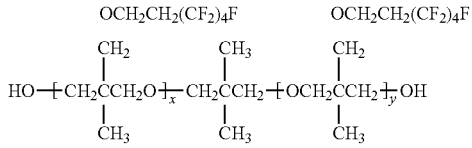

where x and y represent the number of repeating segments, and more specifically, for example, wherein x is from about 1 to about 40, from about 2 to about 20, or from about 5 to about 12, and y is from about 1 to about 40, from about 2 to about 20, or from 5 to about 10, and the sum of x and y is from about 2 to about 60, from about 4 to about 30 or from 7 to about 18.

The fluorine or fluoride (F) content of the fluoro component as determined by known methods, such as IR spectroscopy, is for example, from about 10 to about 70 weight percent, from about 20 to about 50 weight percent, or from about 45 to about 50 weight percent, with the weight average molecular weight $M_w$ of the fluoro component as determined by GPC analysis being, for example, from about 500 to about 8,000, from about 1,000 to about 6,000, or from about 2,500 to about 5,500. The hydroxyl number of the fluoro compound as determined by known methods, such as gravimetric analysis, is for example, from about 20 to about 200 milligrams KOH/gram, from about 50 to about 125 milligrams KOH/gram, or from about 75 to about 100 milligrams KOH/gram.

Examples of fluoro components encompassed by the above formulas/structures and available from OMNOVA Solutions Incorporated are POLYFOX™ PF-7002, with a weight average molecular weight of about 1,670, a fluoride (F) content of about 46 percent, and a hydroxyl number of about 67.2 milligrams KOH/gram. Other examples of fluoro components that may be selected for the photoconductor overcoat layer include POLYFOX™ PF-636, having a weight average molecular weight of about 1,150, a fluoride (F) of about 27.6 percent, and a hydroxyl number of about 99.5 milligrams KOH/gram; POLYFOX™ PF-6320, having a weight average molecular weight of about 3,480, a fluoride content (F) of about 29.9 percent, and a hydroxyl number of about 32.2 milligrams KOH/gram; POLYFOX™ PF-656, with a weight average molecular weight of about 1,490, a fluoride content (F) of about 34.7 percent, and a hydroxyl number of about 75.2 milligrams KOH/gram; POLYFOX™ PF-6520, having a weight average molecular weight of about 4,480, a fluoride content (F) of about 39.3 percent, and a hydroxyl number of about 25 milligrams KOH/gram; POLYFOX™ PF-151N, having a weight average molecular weight of about 2,815, a fluorine content (F) of about 24.5 percent, and a hydroxyl number of about 39.9 milligrams KOH/gram; POLYFOX™ PF-154N, having a weight average molecular weight of about 3,464, a fluoride content (F) of about 19.5 percent, and a hydroxyl number of about 32.4 milligrams KOH/gram; and POLYFOX™ PF-159, with a weight average molecular weight of about 3,300, a fluoride content (F) of about 15.4 percent, and a hydroxyl number of about 34 milligrams KOH/gram, and mixtures thereof.

Overcoat Charge Transport Components

Examples of the charge transport components, especially hole transport components or compounds selected for the overcoat layer mixture, and which layer can possess oleophobic characteristics, include hydroxyl or alkoxy compounds, and where the alkoxy compounds are represented by the following formulas/structures wherein Me is alkyl with, for example, from about 1 to about 12, from 1 to about 7, or from 1 to about 4 carbon atoms, inclusive of methyl, ethyl, propyl, butyl, pentyl, hexyl, heptyl, octyl, nonyl, decyl, and the like

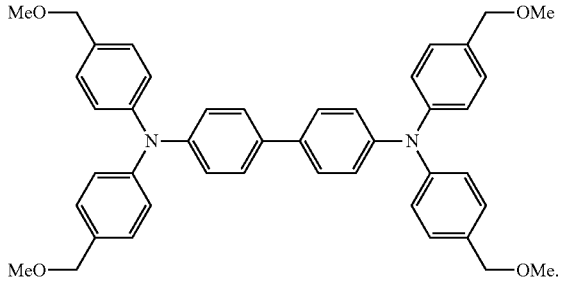

In embodiments, the charge transport component or compound selected for the photoconductor overcoat layer is alcohol soluble compound, which can be optionally crosslinked, as represented by

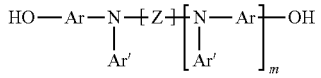

wherein m represents the number of segments, and is, for example, 0 or 1; Z is selected from the group consisting of at least one of

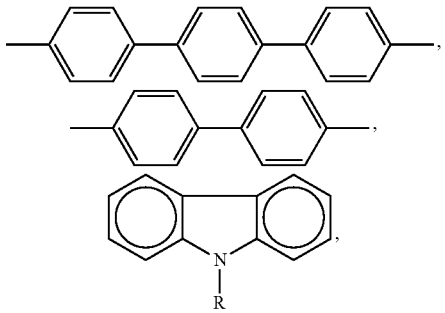

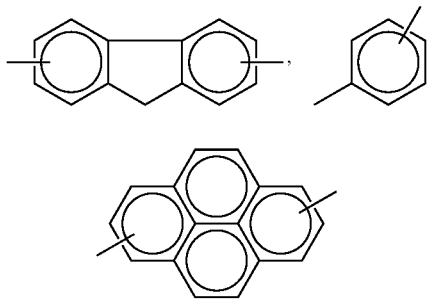

and

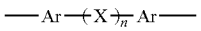

wherein n represents the number of X substituents, such as 0 or 1, and R is alkyl; Ar is selected from the group consisting of at least one of

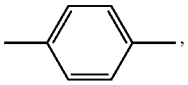

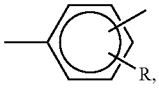

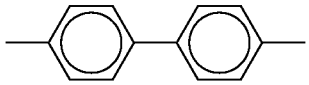

and

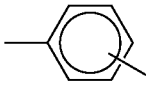

where R is selected from the group consisting of at least one of alkyl like methyl, ethyl, propyl, butyl, pentyl, and the like; Ar' is selected from the group consisting of at least one of

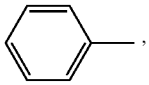

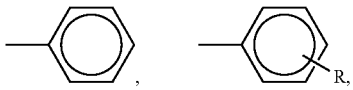

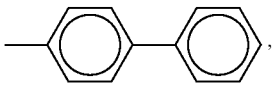

and

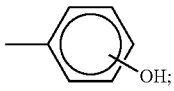

X is selected from the group consistinq of at least one of

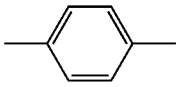

$—CH_2—$ $—CH(CH_3)—$ $—O—$ $—S—$

-continued

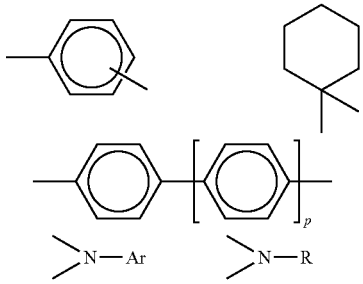

wherein p represents the number of segments, and is, for example, zero, 1, or 2; R is alkyl, and Ar is selected from the group consisting of at least one of the substituents represented by the following formulas/structures

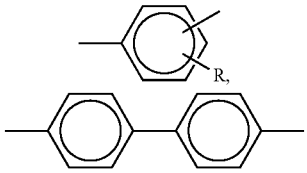

and

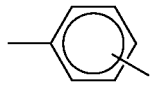

wherein R is alkyl.

Charge transport compounds present in the overcoat layer also include those represented by at least one of

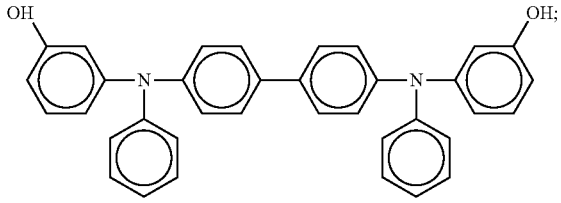

and

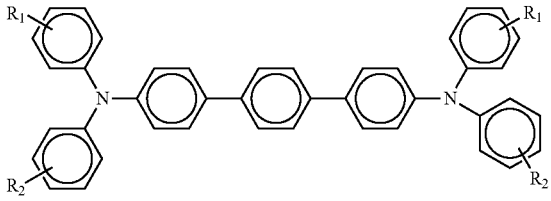

wherein each $R_1$ and $R_2$ are independently selected from the group consisting of at least one of a hydrogen atom, a hydroxy group, a group represented by $—C_nH_{2n+1}$, where n is from 1 to about 12, or from 1 to about 6, and aryl groups with from about 6 to about 36 carbon atoms, from about 6 to about 24 carbon atoms, from 6 to about 18 carbon atoms, or from 6 to about 12 carbon atoms; mixtures thereof; and mixtures of hydroxyl aryl amines and dihydroxyaryl terphenylamines.

Melamine Resins

In various embodiments, the melamine resin selected for the overcoat layer can be represented by the following formulas/structures:

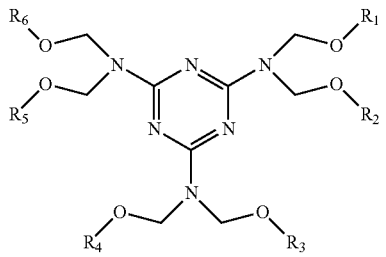

wherein $R_1$, $R_2$, $R_3$, $R_4$, $R_5$ and $R_6$ each independently represent at least one of a hydrogen atom, and an alkyl group with, for example, from 1 to about 12 carbon atoms, from 1 to about 8 carbon atoms, or from 1 to about 4 carbon atoms. Examples of specific alkyl groups include methyl, ethyl, propyl, butyl, pentyl, hexyl, heptyl, octyl, nonyl, decyl, and the like.

Examples of melamine resins selected for the overcoat layer include methylated and/or butylated melamine formaldehyde resins, such as those commercially available from Cytec Industries, as CYMEL® 303, 104, MM-100, and the like; from Sanwa Chemical Co., Limited. of Japan, as NIKANAC® M-390; and the like. The melamine formaldehyde resins, which are water soluble, dispersible or nondispersible, may exhibit a high percent of alkylation, such as from about 75 to about 95 percent, from about 80 to about 95 percent, from about 75 to about 90 percent, or from about 85 to about 90 percent.

Specific examples of melamine resins suitable for use in the overcoat layer disclosed herein include highly alkylated/alkoxylated resins of, for example, having a percent alkylation/alkoxylation of from about 75 to about 95 percent, from 80 to about 95 percent, from about 75 to about 90 percent, or from about 85 to about 90 percent; partially or mixed alkylated/alkoxylated resins of, for example, having from about 40 to about 65 percent alkylation/alkoxylation; methylated, n-butylated or isobutylated resins; highly methylated melamine resins, such as CYMEL® 350, 9370; methylated imino melamine resins (partially methylolated and highly alkylated), such as CYMEL® 323, 327; partially methylated melamine resins (highly methylolated and partially methylated), such as CYMEL® 373, 370; high solids mixed ether melamine resins, such as CYMEL® 1130, 324; n-butylated melamine resins such as CYMEL® 1151, 615; n-butylated high imino melamine resins, such as CYMEL® 1158; and isobutylated melamine resins, such as CYMEL® 255-10. CYMEL® melamine resins are commercially available from CYTEC Industries, Inc.

More specifically, the overcoat melamine resin may be selected from the group consisting of methylated melamine resins, methoxymethylated melamine resins, ethoxymethylated melamine resins, propoxymethylated melamine resins, butoxymethylated melamine resins, hexamethylol melamine resins, and mixtures thereof.

A methoxymethylated melamine resin CYMEL® 303, available from Cytec Industries as $(CH_3OCH_2)_6N_3C_3N_3$, and selected for the overcoat layer illustrated herein is represented by the following formula/structure

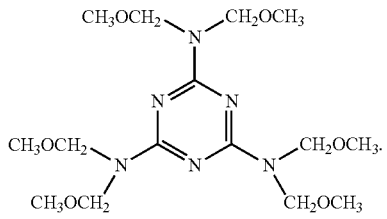

The melamine resin, which can function as a crosslinking agent, can be present in the overcoat layer mixture in an amount of from about 1 to about 65 weight percent, from about 2 to about 50 weight percent, or from about 3 to about 35 weight percent based on the total weight of the overcoat layer component solids. The charge transport compound can be present in the overcoat layer mixture in an amount of from about 20 to about 80 weight percent, from about 30 to about 75 weight percent, or from about 40 to about 70 weight percent based on the total solids of the overcoat layer. While not being desired to be limited by theory, it is believed that the crosslinking percentage of the overcoat layer components subsequent to curing is, for example, from about 55 to about 99 percent, from about 77 to about 97 percent, from about 80 to about 95 percent, or from about 70 to about 90 percent, as determined by known methods, such as determined with Fourier Transform Infrared Spectroscopy (FTIR).

Catalyst

The crosslinking reaction of the melamine resin, the fluoro component, and the charge transport material can be accomplished with an acid catalyst, such as a strong acid catalyst. The acid catalyst can be unblocked or blocked. Examples of acid catalysts selected for the crosslinking reaction include p-toluene sulfonic acid (p-TSA), dinonylnaphthalenedisulfonic acid (DNNDSA), dinonylnaphthalenesulfonic acid (DNNSA), dodecylbenzenesulfonic acid (DDBSA), commercially available acid catalysts, available from CYCAT® (Cytec Industries, Inc.) such as CYCAT® 600, CYCAT® 4040, and NACURE® (Kings Industries, Inc.) such as NACURE® 3525, NACURE® 1557, NACURE® 5225, NACURE® 2530, NACURE® XP-357, and the like. In embodiments, the catalyst can be added to the overcoat layer mixture components in an amount of from about 0.1 to about 5 weight percent, from about 0.3 to about 3 weight percent, or from about 0.4 to about 1 weight percent.

For the photoconductor overcoat mixtures, various processes can be utilized to obtain the crosslinking thereof. For example, the overcoat mixture of the fluoro component, the charge transport compound, a solvent, the melamine resin, and the acid catalyst can be heated and cured with stirring to a temperature of from about 120 to about 200° C., or from about 150 to about 175° C. for a period of time of, for example, from about 30 to about 75 minutes, or from about 40 to about 60 minutes, followed by cooling the resulting mixture to room temperature of about 25° C. There results a crosslinked network of the charge transport compound, the fluoro component, and the melamine resin. Also, the crosslinked overcoat can include the catalyst in the amounts illustrated herein.

Optional Overcoat Layer Additives

Additionally, there may be included in the overcoat layer low surface energy components, such as hydroxyl terminated fluorinated additives, hydroxyl silicone modified polyacrylates, and mixtures thereof. Examples of the low surface energy components, present in various effective amounts, such as from about 0.1 to about 10 weight percent, from about 0.5 to about 5 weight percent, or from about 1 to about 3 weight percent, are hydroxyl derivatives of perfluoropolyoxyalkanes such as FLUOROLINK® D (M.W. about 1,000 and fluorine content about 62 percent), FLUOROLINK® D10-H (M.W. about 700 and fluorine content about 61 percent), and FLUOROLINK® D10 (M.W. about 500 and fluorine content about 60 percent) (functional group —$CH_2OH$); FLUOROLINK® E (M.W. about 1,000 and fluorine content about 58 percent), and FLUOROLINK® E10 (M.W. about 500 and fluorine content about 56 percent) (functional group —$CH_2(OCH_2CH_2)_nOH$); FLUOROLINK® T (M.W. about 550 and fluorine content about 58 percent) and FLUOROLINK® T10 (M.W. about 330 and fluorine content about 55 percent) (functional group —$CH_2OCH_2CH(OH)CH_2OH$); and hydroxyl derivatives of perfluoroalkanes ($R_fCH_2CH_2OH$, wherein $R_f$=$F(CF_2CF_2)_n$) such as ZONYL® BA (M.W. about 460 and fluorine content about 71 percent), ZONYL® BA-L (M.W. about 440 and fluorine content about 70 percent), ZONYL® BA-LD (M.W. about 420 and fluorine content about 70 percent), and ZONYL® BA-N (M.W. about 530 and fluorine content about 71 percent); carboxylic acid derivatives of fluoropolyethers such as FLUOROLINK® C (M.W. about 1,000 and fluorine content about 61 percent), carboxylic ester derivatives of fluoropolyethers such as FLUOROLINK® L (M.W. about 1,000 and fluorine content about 60 percent), FLUOROLINK® L10 (M.W. about 500 and fluorine content about 58 percent), carboxylic ester derivatives of perfluoroalkanes ($R_fCH_2CH_2O(C{=}O)R$, wherein $R_f$=$F(CF_2CF_2)_n$ and R is alkyl such as ZONYL® TA-N (fluoroalkyl acrylate, R=$CH_2{=}CH$—, M.W. about 570 and fluorine content about 64 percent), ZONYL® TM (fluoroalkyl methacrylate, R=$CH_2{=}C(CH_3)$—, M.W. about 530 and fluorine content about 60 percent), ZONYL® FTS (fluoroalkyl stearate, R=$C_{17}H_{35}$—, M.W. about 700 and fluorine content about 47 percent), ZONYL® TBC (fluoroalkyl citrate, M.W. about 1,560 and fluorine content about 63 percent), sulfonic acid derivatives of perfluoroalkanes ($R_fCH_2CH_2SO_3H$, wherein $R_f$=$F(CF_2CF_2)_n$) such as ZONY®L TBS (M.W. about 530 and fluorine content about 62 percent); ethoxysilane derivatives of fluoropolyethers such as FLUOROLINK® S10 (M.W. about 1,750 to 1,950); phosphate derivatives of fluoropolyethers such as FLUOROLINK® F10 (M.W. about 2,400 to 3,100); hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, Inc., ZONYL® is a trademark of E.I. DuPont, and BYK-SILCLEAN® is a trademark of BYK Silclean.

Solvents

Examples of solvents that can be selected for the preparation of the overcoating mixture and for deposition of the film forming overcoat layer, include primary, secondary, and tertiary alcohol solvents or mixtures thereof. Typical alcohol solvents include, but are not limited to alkyl containing solvents like tert-butanol, sec-butanol, n-butanol, iso-propanol, 1-methoxy-2-propanol, cyclopentanol, and the like, DOWANOL® PM and mixtures thereof. There may also be selected as solvents for dissolving the overcoat layer mixture cyclopentanone, tetrahydrofuran, monochlorobenzene, methylene chloride, toluene, xylene, and mixtures thereof. The solvent is present in the overcoat layer coating solution in an amount of from about 50 to about 90 weight percent, or from about 60 to about 80 weight percent, and the solvent is usually not present except for residues thereof in the final dried overcoat layer.

The thickness of the overcoat layer as measured with a Permascope is from about 1 to about 20 microns, from about 1 to about 15 microns, from about 1 to about 10 microns, or from about 1 to about 5 microns.

Typical application techniques for applying the overcoat layer over the outermost photoconductor layer can include spraying, dip coating, roll coating, wire wound rod coating, extrusion coating, flow coating, and the like. Drying of the deposited overcoat layer can be effected by any suitable conventional technique such as oven drying, infrared radiation drying, air drying, and the like and where most if not all of the solvent is removed.

Drying of the deposited overcoat layer can be effected by any suitable conventional processes, such as oven drying, infrared radiation drying, air drying, and the like, and where the solvent is removed.

The applied overcoat layer mixture or crosslinked mixture has acceptable electrical properties and an excellent wear rate of from about 1 to about 20 nanometers/kilocycle, from about 5 to about 20 nanometers/kilocycle, from about 3 to about 15 nanometers/kilocycle, or from about 4 to about 10 nanometers/kilocycle. The wear rate can be determined by known methods as illustrated herein and using a wear test fixture The weight ratio amount of the overcoat layer components of the charge transport compound, fluoro component or compound, melamine resin and catalyst is, for example, from about 30/5/65/0.1 to about 70/25/5/1, from about 40/10/50/0.2 to about 60/20/20/0.5, or about 40/30/30/1.

Optional Substrate

The substrate selected for the photoconductors of the present disclosure may comprise a layer of an electrically substantially nonconductive material or a layer of a conductive material. Examples of known non-conducting supporting substrate materials include polyesters, polycarbonates, polyamides, polyurethanes, and the like, and mixtures thereof.

In embodiments, when the photoconductor supporting substrate layer is not conductive, the surface may be rendered electrically conductive by depositing thereon a known electrically conductive coating like a coating of a metal oxide. The conductive coating may vary in thickness, such as from about 1 to about 50 microns, from 1 to about 35 microns, or from about 3 to about 25 microns, depending upon the optical transparency to be achieved, degree of flexibility desired, and economic factors.

An electrically conducting supporting substrate that may be selected for the photoconductors illustrated herein include metal containing polymers, titanium containing MYLAR®, metals including aluminum, nickel, steel, copper, gold, and the like, and mixtures thereof filled with an electrically conducting substance. Examples of electrically conducting substances include carbon, metallic powder, and the like, or an organic electrically conducting material.

Illustrative examples of photoconductor supporting substrates include a layer of insulating material including inorganic or organic polymeric materials, such as MYLAR® (a commercially available polymer), a MYLAR® containing titanium layer, a layer of an organic or inorganic material having a semiconductive surface layer, such as indium tin oxide or aluminum arranged thereon, or a conductive material inclusive of aluminum, chromium, nickel, brass, or the like, and mixtures thereof.

The thickness of the photoconductor supporting substrate depends on many factors, including economical considerations, electrical characteristics, adequate flexibility, availability, and cost of the specific components for each layer, and the like. Thus, this layer may be of a substantial thickness, for example up to about 3,000 microns, such as from about 1,000 to about 2,000 microns, from about 500 to about 1,000 microns, or from about 300 to about 700 microns, or of a minimum thickness of from about 75 to about 100 microns. In embodiments, the thickness of this layer is from about 75 to about 300 microns or from about 100 to about 150 microns.

The substrate may be flexible, seamless, or rigid, and may have a number of many different configurations, such as, for example, a plate, a cylindrical drum, a scroll, an endless flexible belt, a drelt (a cross between a drum and a belt), and the like. In embodiments, the photoconductor substrate is in the form of a seamless flexible belt.

Optional Anticurl Layer

In some situations, it may be desirable to coat a known anticurl layer on the back of the photoconductor substrate, particularly when the substrate is a flexible organic polymeric material. This anti-curl layer is sometimes referred to as an anticurl backing layer. Suitable materials selected for the photoconductor anti-curl layer include, for example, polycarbonates commercially available as MAKROLON®, polyesters, polyarylates, polystyrenes, poly(4,4'-isopropylidene diphenylcarbonate)s, poly(4,4'-cyclohexylidene diphenylcarbonate)s, mixtures thereof, and the like. The anti-curl layer can be of a thickness of from about 5 to about 40 microns, from about 10 to about 30 microns, or from about 15 to about 25 microns.

Additives may be present in the anti-curl layer in, for example, an amount of from about 0.5 to about 40 weight percent, or from about 5 to about 12 weight percent of the anti-curl layer solids. Additives include organic and inorganic particles that may further improve the wear resistance and/or provide charge relaxation properties. Organic particles include TEFLON powder, carbon black, and graphite particles. Inorganic particles include insulating and semiconducting metal oxide particles such as silica, zinc oxide, tin oxide, and the like.

Typical anti-curl adhesion promoters useful as additives in the overcoat layer include, but are not limited to DuPont 49,000 polyester, Vitel PE-100, Vitel PE-200, Vitel PE-307, all available from Goodyear Tire and Rubber Company, mixtures thereof, and the like. Usually from about 1 to about 15 weight percent or from about 1 to about 4 weight percent adhesion promoter is selected based on the weight of solids in the anti-curl layer.

The anti-curl coating may be applied as a solution prepared by dissolving a film-forming resin and an adhesion promoter in a solvent such as methylene chloride. Thereafter, the solution may be applied to the rear surface of the supporting substrate (the side opposite the imaging layers) of the photoreceptor or photoconductor by, for example, web coating, or by other known methods. Coating of the overcoat layer and the anti-curl layer may be accomplished simultaneously by web coating onto the multilayer imaging member illustrated herein.

Optional Ground Plane Layer

Positioned on the top side of the supporting substrate there can be included an optional ground plane layer such as gold, gold containing compounds, aluminum, titanium, titanium/zirconium, and other suitable known components. The thickness of the ground plane layer can be from about 10 to about 100 nanometers, from about 20 to about 50 nanometers, from about 10 to about 30 nanometers, from about 15 to about 25 nanometers, or from about 20 to about 35 nanometers.

Optional Hole-Blocking Layer

An optional charge blocking layer or hole blocking layer may be applied to the photoconductor supporting substrate, such as an electrically conductive supporting substrate surface prior to the application of a photogenerating layer. An optional charge blocking layer or hole blocking layer, when present, is usually in contact with the ground plane layer, and also can be in contact with the supporting substrate. The hole blocking layer generally comprises any of a number of known components as illustrated herein, such as metal oxides, phenolic resins, aminosilanes, and the like, and mixtures thereof. The hole blocking layer can have a thickness of from about 0.01 to about 30 microns, from about 0.02 to about 5 microns, or from about 0.03 to about 2 microns.

Examples of aminosilanes included in the hole blocking layer can be represented by the following formula/structure

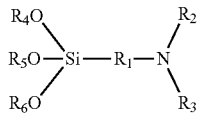

wherein $R_1$ is alkylene, straight chain or branched, containing from 1 to about 25 carbon atoms, from 1 to about 18 carbon atoms, from 1 to about 12 carbon atoms, or from 1 to about 6 carbon atoms; $R_2$ and $R_3$ are independently selected from the group consisting of at least one of a hydrogen atom, alkyl containing from 1 to about 12 carbon atoms, or from 1 to about 4 carbon atoms, aryl containing from about 6 to about 24 carbon atoms, from about 6 to about 18 carbon atoms, or from about 6 to about 12 carbon atoms, such as a phenyl group; and a poly(alkylene amino) group, such as a poly (ethylene amino) group, and where $R_4$, $R_5$ and $R_6$ are independently an alkyl group containing from 1 to about 12 carbon atoms, from 1 to about 10 carbon atoms, or from 1 to about 4 carbon atoms.

Specific examples of suitable hole blocking layer aminosilanes include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropyl methyl diethoxysilane, 3-aminopropyl trimethoxysilane, N-methylaminopropyl triethoxysilane, methyl [2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Yet more specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

The hole blocking layer aminosilane may be treated to form a hydrolyzed silane solution before being added into the final hole blocking layer coating solution or dispersion. During hydrolysis of the aminosilanes, the hydrolyzable groups, such as the alkoxy groups, are replaced with hydroxyl groups. The pH of the hydrolyzed silane solution can be controlled to from about 4 to about 10, or from about 7 to about 8 to thereby result in photoconductor electrical stability. Control of the pH of the hydrolyzed silane solution may be affected with any suitable material, such as generally organic acids or inorganic acids. Examples of organic and inorganic acids selected for pH control include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the photoconductor supporting substrate, or on to the ground plane layer by the use of a spray coater, dip coater, extrusion coater, roller coater, wire-bar coater, slot coater, doctor blade coater, gravure coater, and the like, and dried at from about 40 to about 200° C. or from 75 to 150° C. for a suitable period of time, such as from about 1 to about 4 hours, from about 1 minute to about 10 hours, or from about 40 to about 100 minutes in the presence of an air flow. The hole blocking layer coating can be accomplished in a manner to provide a final hole blocking layer coating thickness after drying of, for example, from about 0.01 to about 30 microns, from about 0.02 to about 5 microns, or from about 0.03 to about 2 microns.

Optional Adhesive Layer

An optional adhesive layer may be included between the hole blocking layer and the photogenerating layer. Typical adhesive layer materials selected for the photoconductors illustrated herein include polyesters, polyurethanes, copolyesters, polyamides, poly(vinyl butyrals), poly(vinyl alcohols), polyacrylonitriles, and the like, and mixtures thereof. The adhesive layer thickness can be from about 0.001 to about 1 micron, from about 0.05 to about 0.5 micron, or from about 0.1 to about 0.3 micron. Optionally, the adhesive layer may contain effective suitable amounts of from about 1 to about 10 weight percent, or from 1 to about 5 weight percent of conductive and nonconductive particles, such as zinc oxide, titanium dioxide, silicon nitride, carbon black, polymers, and the like, and mixtures thereof.

Photogenerating Layer

Usually, the photogenerating layer is applied onto the supporting substrate, and a charge transport layer or plurality of charge transport layers are formed on the photogenerating layer. The charge transport layer may be situated on the photogenerating layer, the photogenerating layer may be situated on the charge transport layer, or when more than one charge transport layer is present, they can be contained on the photogenerating layer. Also, the photogenerating layer may be applied to layers that are situated between the supporting substrate and the charge transport layer.

Generally, the photogenerating layer can contain known photogenerating pigments, such as metal phthalocyanines, metal free phthalocyanines, alkylhydroxyl gallium phthalocyanines, hydroxygallium phthalocyanines, a halogallium phthalocyanine, chlorogallium phthalocyanines, perylenes, such as bis(benzimidazo)perylene, titanyl phthalocyanines, and the like, and mixtures thereof.

Examples of photogenerating pigments are vanadyl phthalocyanines, Type V hydroxygallium phthalocyanines, high sensitivity titanyl phthalocyanines, quinacridones, polycyclic pigments such as dibromo anthanthrone pigments, perinone diamines, polynuclear aromatic quinones, azo pigments including bis-, tris- and tetrakis-azos, and the like; inorganic components such as selenium, selenium alloys, and trigonal selenium; and pigments of crystalline selenium and its alloys. The photogenerating pigment can be dispersed in a resin binder similar to the resin binders selected for the charge transport layer, or alternatively no resin binder need be present. For example, the photogenerating pigments can be present in an optional resinous binder composition in various amounts inclusive of up to 99.5 percent by weight. From about 5 to about 95 percent by volume of the photogenerating pigment is dispersed in about 95 to about 5 percent by volume of a resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition.

Examples of polymeric binder materials that can be selected as the matrix for the photogenerating layer pigments include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyimides, amino resins, phenylene oxide resins, terephthalic acid resins, phenoxy resins, epoxy resins, phenolic resins, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like, inclusive of block, random, or alternating copolymers thereof.

It is often desirable to select a coating solvent for the photogenerating layer mixture, and which solvent does not substantially disturb or adversely affect the previously coated layers of the photoconductor. Examples of coating solvents used for the photogenerating layer coating mixture include ketones, alcohols, aromatic hydrocarbons, halogenated aliphatic hydrocarbons, ethers, amines, amides, esters, and the like, and mixtures thereof. Specific solvent examples selected for the photogenerating mixture are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer can be of a thickness of from about 0.01 to about 10 microns, from about 0.05 to about 10 microns, from about 0.2 to about 2 microns, or from about 0.25 to about 1 micron.

Charge Transport Layer

The charge transport layer or layers, such as from 1 to about 4 layers, and more specifically, in embodiments, a first charge transport layer in contact with the photogenerating layer, and over the first charge transport layer a top or second charge transport overcoating layer, may each comprise charge transporting compounds or molecules dissolved or molecularly dispersed in a film forming electrically inert polymer such as a polycarbonate. In embodiments, "dissolved" refers, for example, to forming a solution in which the charge transport molecules are dissolved in a polymer to form a homogeneous phase; and "molecularly dispersed" refers, for example, to charge transporting molecules or compounds dispersed on a molecular scale in a polymer.

Charge transport refers, for example, to charge transporting molecules that allow the free charge generated in the photogenerating layer to be transported across the charge transport layer. The charge transport layer is usually substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge present on the surface of the photoconductor.

A number of charge transport compounds can be included in the charge transport layer or in at least one charge transport layer, such as from 1 to about 4 layers, or from 1 to about 2 layers. Examples of charge transport components or compounds are selected from the group consisting of those represented by the following formulas/structures

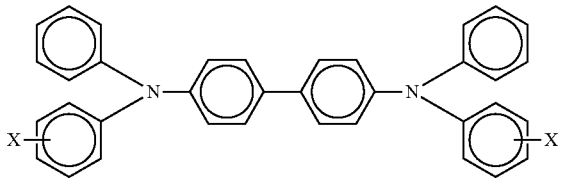

and

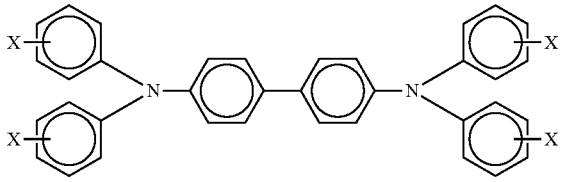

wherein X is a suitable hydrocarbon like alkyl, alkoxy, aryl, and derivatives thereof; a halogen, or mixtures of a suitable hydrocarbon and a halogen, and charge transport compounds as represented by the following formula/structure

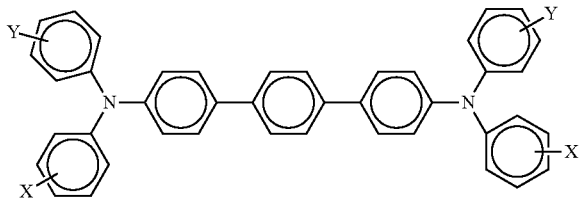

wherein X and Y are independently alkyl, alkoxy, aryl, a halogen, or mixtures thereof.

Alkyl and alkoxy for the photoconductor charge transport layer compounds illustrated herein contain, for example, from about 1 to about 25 carbon atoms, from about 1 to about 12 carbon atoms, or from about 1 to about 6 carbon atoms, such as methyl, ethyl, propyl, butyl, pentyl, hexyl, heptyl, octyl, nonyl, decyl, undecyl, dodecyl, pentadecyl, and the like, and the corresponding alkoxides. Aryl substituents for the charge transport layer compounds can contain from 6 to about 36 carbon atoms, from 6 to about 24 carbon atoms, from 6 to about 18 carbon atoms, or from 6 to about 12 carbon atoms, such as phenyl, naphthyl, anthryl, and the like. Halogen substituents for the charge transport layer compounds include chloride, bromide, iodide, and fluoride. Substituted alkyls, alkoxys, and aryls can also be selected for the charge transport layer compounds.

Examples of specific aryl amines present in at least one photoconductor charge transport layer, in an amount of from about 40 to about 80 weight percent, from about 50 to about 75 weight percent, or from about 40 to about 60 weight percent, include N,N'-diphenyl-N,N'-bis(alkylphenyl)-1,1-biphenyl-4,4'-diamine wherein alkyl is selected from the group consisting of methyl, ethyl, propyl, butyl, hexyl, heptyl, octyl, nonyl, decyl, undecyl, dodecyl, pentadecyl, and the like; N,N'-diphenyl-N,N'-bis(halophenyl)-1,1'-biphenyl-4,4'-diamine wherein the halo substituent is chloro; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like; hydrazones such as N-phenyl-N-methyl-3-(9-ethyl)carbazyl hydrazone and 4-diethylamino benzaldehyde-1,2-diphenyl hydrazone; and oxadiazoles, such as 2,5-bis(4-N,N'-diethylaminophenyl)-1,2,4-oxadiazole, stilbenes, and the like.

Examples of optional charge transport layer resin binders present in various amounts, and where the total weight percent of the binder and the charge transport compound equals about 100 weight percent include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), PCZ-400 poly(4,4'-dihydroxy-diphenyl-1-1-cyclohexane) carbonate, and the like. In embodiments, electrically inactive binders that can be selected for the charge transport layer or charge transport layers are comprised of polycarbonate resins with a weight average molecular weight $M_w$ of from about 20,000 to about 100,000, or of from about 50,000 to about 100,000.

The ratio of the binder to the charge transport compound present in the charge transport layer or in at least one charge transport layer can vary depending, for example, on the thicknesses of the imaging member layers, and the properties desired. Typically, the ratio of the binder to the charge transport compound, as primarily determined by the initial feed amounts of each, can range from about 50:50 to about 80:20, such as from about 55:45 to about 75:25, or from about 60:40 to about 70:30, or values in between these amounts.

A number of processes may be used to mix, and thereafter apply the charge transport layer or layers coating mixture to the photogenerating layer. Typical application techniques include spraying, dip coating, roll coating, wire wound rod coating, and the like. Drying of the charge transport deposited layer coating or layer coatings may be affected by any suitable conventional technique such as oven drying, infrared radiation drying, air drying, and the like.

The thickness of the charge transport layer or charge transport layers, in embodiments, is from about 5 or about 10 to about 70 microns, from about 20 to about 65, from about 15 to about 50, or from about 10 to about 40 microns, but thicknesses outside this range may, in embodiments, also be selected. The charge transport layer should be an insulator to the extent that an electrostatic charge placed on the charge transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances can be about 400:1.

The disclosed charge transport layer compounds illustrated for the charge transport layer can also be selected for the overcoat layer.

Examples of components or materials optionally incorporated into at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

Also included within the scope of the present disclosure are methods of imaging and printing with the photoconductors illustrated herein. These methods generally involve the formation of an electrostatic latent image on the imaging member, followed by developing the image with a toner composition comprised, for example, of thermoplastic resin, colorant, such as pigment, charge additive, and surface additive, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductors disclosed herein can be selected for the Xerox Corporation iGEN® machines that generate with some versions over 100 copies per minute. Processes of imaging, especially xerographic imaging and printing, including digital and/or color printing are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying, and printing processes inclusive of digital xerographic processes.

The thicknesses of each of the photoconductor layers illustrated herein were determined by known analytical methods, and more specifically, by the use of a Permascope. The molecular weights of each of the components and compounds illustrated herein were determined by Gel Permeation Chromatography (GPC).

The following Examples are being submitted to illustrate embodiments of the present disclosure. These Examples are intended to be illustrative only, and are not intended to limit the scope of the present disclosure. Also, parts and percentages are by weight unless otherwise indicated, and the weight percents are based on the solids contents. Comparative Examples and data are also provided.

EXAMPLE I

Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting undercoat layer solution was then coated by a dip coater on a 30 millimeter thick aluminum drum substrate. The coating solution layer was preheated at 59° C. for 13 minutes, humidified at 58° C. (dew point=54° C.) for 17 minutes, and dried at 135° C. for 8 minutes. The thickness of the resulting undercoat layer was approximately 1.3 microns.

A photogenerating layer of a thickness of about 0.2 micron comprising hydroxygallium phthalocyanine Type V was deposited on the above hole blocking layer or undercoat layer at a thickness of about 1.3 microns. The photogenerating layer coating dispersion was prepared as follows. Three grams of the hydroxygallium phthalocyanine Type V pigment were mixed with 2 grams of a polymeric binder of a carboxyl-modified vinyl copolymer, VMCH, available from Dow Chemical Company, and 45 grams of n-butyl acetate. The resulting mixture was milled in an Attritor mill with about 200 grams of 1 millimeter Hi-Bea borosilicate glass beads for about 3 hours. The dispersion obtained was filtered through a 20 micron Nylon™ cloth filter, and the solid content of the dispersion was diluted to about 6 weight percent.

Subsequently, a 20 micron thick charge transport layer was coated on top of the photogenerating layer from a solution prepared from mixing N,N'-diphenyl-N,N-bis(3-methylphenyl)-1,1'-biphenyl-4,4'-diamine (5 grams) and a film forming polymer binder PCZ-400 (poly(4,4'-dihydroxy-diphenyl-1-1-cyclohexane), weight average molecular weight, $M_w$ of 40,000) obtained from Mitsubishi Gas Chemical Company, Ltd. (7.5 grams) in a solvent mixture of 30 grams of tetrahydrofuran (THF), and 10 grams of monochlorobenzene (MCB). The charge transport layer was dried at about 120° C. for about 20 minutes.

An overcoat layer solution was then applied to the above charge transport layer, which solution was formed by mixing and heating 12 grams of the melamine resin CYMEL® 303 (a methylated/butylated melamine-formaldehyde resin obtained from Cytec Industries Inc.), 16 grams of the charge transport compound N,N'-diphenyl-N,N-bis(3-hydroxyphenyl)-[1,1'-biphenyl]-4,4'-diamine), 12.0 grams of the fluoro compound POLYFOX™ PF-7002 and 1.6 grams of NACURE® XP357 (a blocked acid catalyst obtained from King Industries) in 72 grams of iso-propanol (about 35 weight percent solids), or DOWANOL® PM (1-methoxy-2-propanol obtained from the Dow Chemical Company). The resulting overcoat layer was dried and cured in a forced air oven for 40 minutes at 155° C. to yield a highly, about 95 percent, crosslinked 3.5 micron thick overcoat layer. The resulting clear, in color, 3.5 micron overcoat layer exhibited a hexadecane contact angle of about 70° noting that a pure polytetrafluoroethylene (PTFE) containing overcoat layer possessed a hexadecane contact angle of about 45° as measured by a Contact Angle System OCA (Dataphysics Instruments GmbH, model OCA15), thus the above clear overcoat was about 55 percent more oleophobic or lipophobic than a PTFE containing layer.

The ratio of PCZ-400 to N,N'-diphenyl-N,N-bis(3-methylphenyl)-1,1'-biphenyl-4,4'-diamine in the charge transport layer was 60/40, and the ratio of N,N'-diphenyl-N,N-bis(3-hydroxyphenyl)-[1,1'-biphenyl]-4,4'-diamine to the fluoro compound POLYFOX™ PF-7002 to the melamine resin and acid catalyst in the overcoat layer was 40/30/30/1.

EXAMPLE II

Two photoconductors are prepared by repeating the process of Example I except that there was selected in place of the POLYFOX™ PF-7002, POLYFOX™ PF-6520 and POLYFOX™ PF-656.

COMPARATIVE EXAMPLES 1 AND 2

Photoconductors were prepared by repeating the process of Example I except that no overcoating layer was present for Comparative Example 1, and for Comparative Example 2 the overcoating layer included polytetrafluoroethylene in place of the POLYFOX™ PF-7002.

WEAR TESTING

Wear tests of the photoconductors of Comparative Example 1, Comparative Example 2, and Example I were performed using a wear test fixture (biased charging roll, BCR charging, and peak to peak voltage of 1.8 kilovolts). The total thickness of each photoconductor was measured by a Permascope before each wear test was initiated. Then the photoconductors were separately placed into the wear fixture for 50 kilocycles. The total photoconductor thickness was measured again with the Permascope, and the difference in thickness was used to calculate wear rate (nanometers/kilocycle) of the photoconductors. The smaller the wear rate value the more wear resistant was the photoconductor.

TABLE 1

| | Wear Rate (Nanometers/Kilocycle) |
|---|---|
| Comparative Example 1 | 90.0 |
| Comparative Example 2 | 23.4 |
| Example I | 13.6 |

The 13.6 nanometers/kilocycle wear rate will extend the Example I photoconductor life by about 40 percent versus the Comparative Example 1 photoconductor.

ELECTRICAL PROPERTY TESTING

The above prepared photoconductors were tested in a scanner set to obtain photoinduced discharge cycles, sequenced at one charge-erase cycle, followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The photoconductors were tested at surface potentials of −700 volts with the exposure light intensity incrementally increased by means of a data acquisition system where the current to the light emitting diode was controlled to obtain different exposure levels. The exposure light source was a 780 nanometer light emitting diode. The known xerographic simulation process was completed in an environmentally controlled light tight chamber at ambient conditions (40 percent relative humidity and 22° C.).

Almost identical PIDCs were observed for the Example I and Comparative Example 1 photoconductors.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional anticurl layer, an optional supporting substrate, an optional ground plane layer, an optional hole blocking layer, an optional adhesive layer, a photogenerating layer, a charge transport layer comprising a charge transport compound, and an overcoat layer in contact with said charge transport layer, the overcoat layer comprising a mixture of a charge transport compound, a melamine resin and a fluoro component as represented by at least one of the following formulas/structures

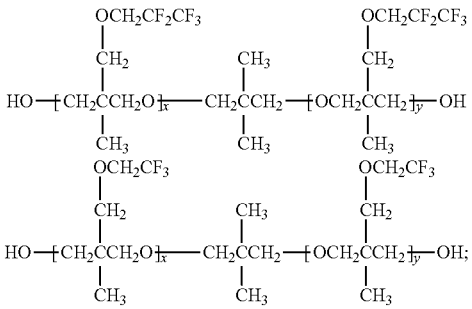

and

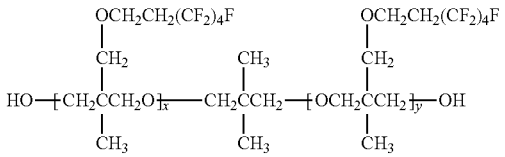

wherein x and y represent the number of repeating segments.

2. A photoconductor in accordance with claim 1 wherein x is from about 1 to about 40, y is from about 1 to about 40, and the sum of x and y is from about 2 to about 60, and wherein the fluoride (F) content is from about 10 to about 70 weight percent.

3. A photoconductor in accordance with claim 1 wherein x is a number of from about 2 to about 20, y is a number of from about 2 to about 20, and the sum of x and y is from about 4 to about 30, and wherein the fluoride (F) content is from about 20 to about 50 weight percent, and which photoconductor possesses a wear rate of from about 5 to about 20 nanometers/kilocycle.

4. A photoconductor in accordance with claim 1 wherein said fluoro component is represented by the following formulas/structures

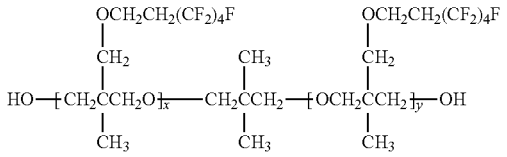

and wherein the fluoride content is from about 45 to about 50 percent.

5. A photoconductor in accordance with claim 1 wherein the weight average molecular weight of said fluoro component is from about 500 to about 8,000, and the hydroxyl number thereof is from about 20 to about 200 milligrams KOH/gram.

6. A photoconductor in accordance with claim 1 wherein said mixture further contains an acid catalyst, and wherein subsequent to curing by heating the mixture is crosslinked to from about 55 to about 99 percent.

7. A photoconductor in accordance with claim 1 wherein said charge transport compound for said overcoat is represented by the following formula/structure

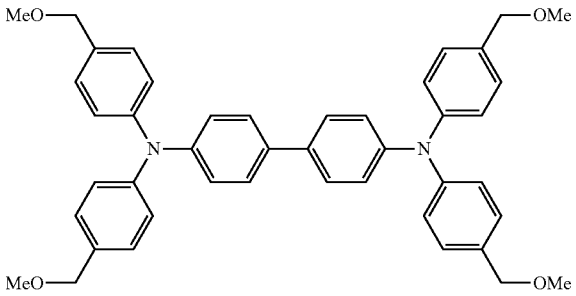

wherein Me is alkyl.

8. A photoconductor in accordance with claim 1 wherein said melamine resin is represented by the following formula/structures

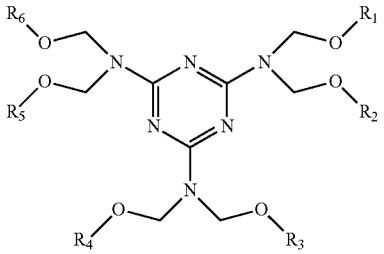

wherein $R_1$, $R_2$, $R_3$, $R_4$, $R_5$ and $R_6$ each independently represents a hydrogen atom or an alkyl group.

9. A photoconductor in accordance with claim 1 wherein said melamine resin is represented by the following formula/structure

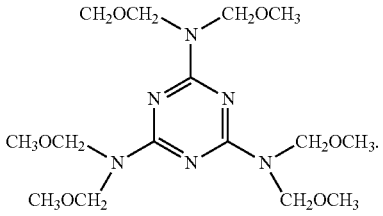

10. A photoconductor in accordance with claim 1 where said melamine resin is selected from the group consisting of methylated melamine resins, methoxymethylated melamine resins, ethoxymethylated melamine resins, propoxymethylated melamine resins, butoxymethylated melamine resins, hexamethylol melamine resins, and mixtures thereof.

11. A photoconductor in accordance with claim 1 wherein said hole blocking layer is present and is comprised of aminosilanes represented by the following formulas/structures

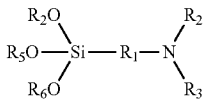

wherein $R_1$ is an alkylene containing from 1 to about 12 carbon atoms, $R_2$ and $R_3$ are independently selected from the group consisting of at least one of a hydrogen atom, alkyl containing from 1 to about 12 carbon atoms, and aryl containing from 6 to about 24 carbon atoms, and where $R_4$, $R_5$ and $R_6$ are alkyl groups containing from 1 to about 12 carbon atoms.

12. A photoconductor in accordance with claim 1 wherein said charge transport compound for said charge transport layer is represented by at least one of the following formulas/structures

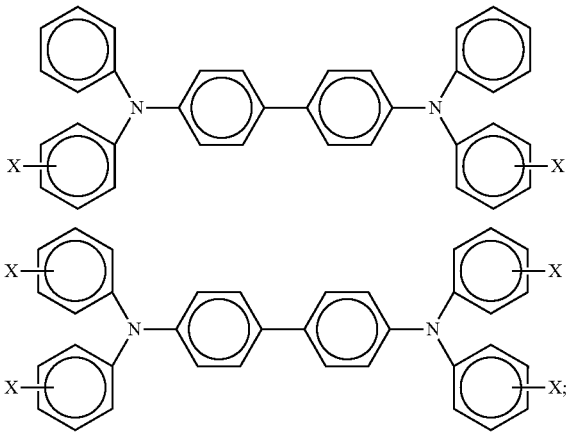

wherein X is selected from the group consisting of alkyl, alkoxy, aryl, halogen, and mixtures thereof, and

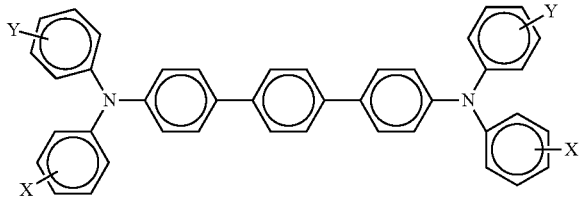

wherein each X and Y is independently selected from the group consisting of at least one of alkyl, alkoxy, aryl, and halogen.

13. A photoconductor in accordance with claim 1 wherein said charge transport compound for said charge transport layer is selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

14. A photoconductor in accordance with claim 1 wherein said charge transport compound in said overcoat layer is represented by

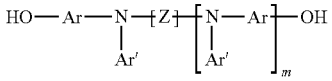

wherein m is 0 or 1; Z is selected from the group consisting of at least one of the components as represented by one of the following formulas/structures

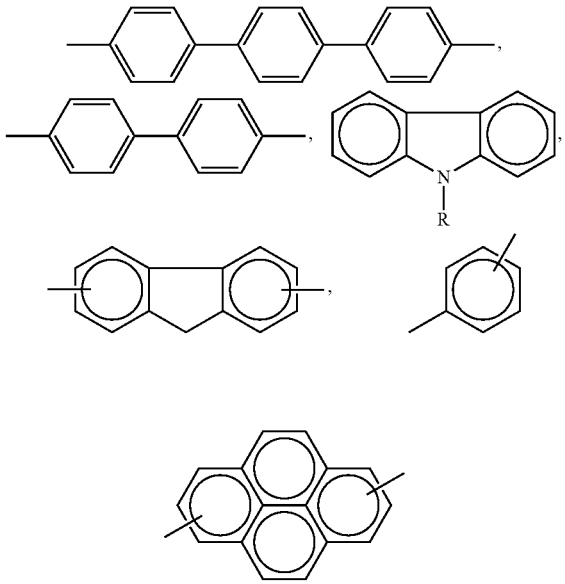

and

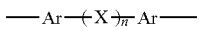

wherein n is 0 or 1, and R is alkyl; Ar is selected from the group consisting of at least one of

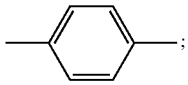

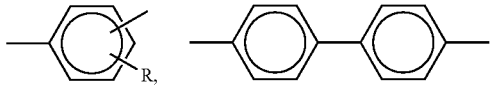

and

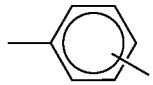

wherein R is alkyl; Ar' is selected from the group consisting of at least one of

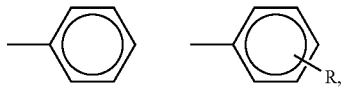

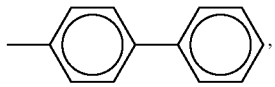

and

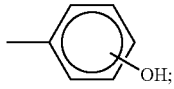

X is selected from the group consisting of at least one of

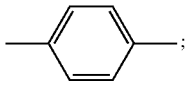

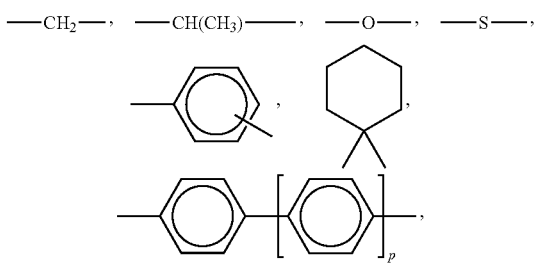

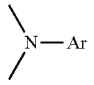

and

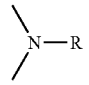

wherein p is zero, 1, or 2; R is alkyl, and Ar is selected from the group consisting of at least one of the substituents represented by the following formulas/structures

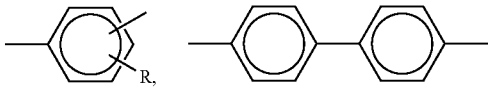

and

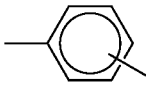

wherein R is alkyl.

15. A photoconductor in accordance with claim 1 wherein said charge transport compound in said overcoat layer is represented by the following formulas/structures

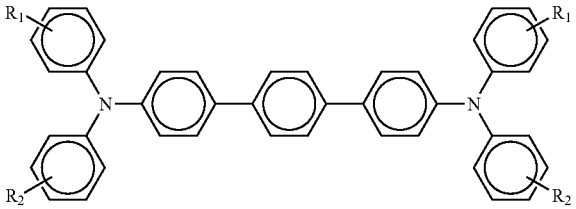

wherein each $R_1$ and $R_2$ is independently selected from the group consisting of at least one of a hydrogen atom, a hydroxyl substituent, a substituent represented by $—C_nH_{2n+1}$ where n is from 1 to about 12, and an aryl group containing from 6 to about 36 carbon atoms.

16. A photoconductor in accordance with claim 1 wherein said photogenerating layer is comprised of photogenerating pigments selected from the group consisting of a titanyl phthalocyanine, a halogallium phthalocyanine, a hydroxygallium phthalocyanine, and mixtures thereof.

17. A photoconductor comprising a supporting substrate, a photogenerating layer, a charge transport layer comprising a charge transport compound and an oleophobic overcoat layer in contact with said charge transport layer, the overcoat layer comprising a mixture of a charge transport compound, a melamine resin, and fluorinated compound as represented by the following formulas/structures

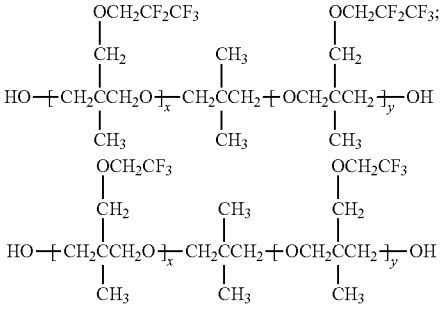

or

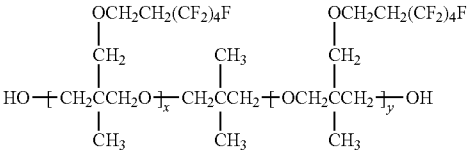

wherein x and y represent the number of repeating segments, with the x repeating segment being a number of from about 1 to about 40, the y repeating segment being a number of from about 1 to about 40, and the sum of x and y is from about 2 to about 60, and wherein the fluoride content is from about 10 to about 70 weight percent.

18. A photoconductor in accordance with claim 17 and which photoconductor possesses a wear rate of from about 5 to about 20 nanometers/kilocycle.

19. A photoconductor comprising an anticurl layer, a supporting substrate, a hole blocking layer, an adhesive layer, a photogenerating layer, at least one charge transport layer comprising a charge transport compound, and an overcoat layer in contact with said at least one charge transport layer, the overcoat layer comprising a crosslinked mixture of a charge transport compound, a melamine resin, an acid catalyst, and a fluoro compound as represented by the following formula/structures

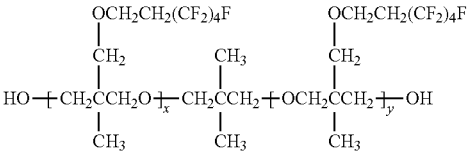

wherein x and y represent the number of repeating segments, and which photoconductor possesses a wear rate of from about 5 to about 20 nanometers/kilocycle, and wherein the mixture is from about 55 to about 99 percent crosslinked as determined by Fourier Transform Infrared Spectroscopy.

20. A photoconductor in accordance with claim 19 wherein said wear rate is from about 3 to about 15 nanometers/kilocycle.

* * * * *